United States Patent [19]

Instance

[11] Patent Number: 4,773,584

[45] Date of Patent: Sep. 27, 1988

[54] LABEL ENVELOPE WITH BACKING SHEET

[76] Inventor: David J. Instance, Past Heap Farm, Pembury, Tunbridge Wells, Kent, England

[21] Appl. No.: 928,583

[22] Filed: Nov. 10, 1986

Related U.S. Application Data

[63] Continuation of Ser. No. 703,591, Feb. 20, 1985, abandoned.

[30] Foreign Application Priority Data

Feb. 24, 1984 [GB] United Kingdom ..... 8404904

[51] Int. Cl.[4] ..... B65D 27/34

[52] U.S. Cl. ..... 229/74; 206/610; 206/632; 229/69; 283/81

[58] Field of Search ..... 229/74, 75, 69, 68; 206/610, 632; 283/103, 105, 81, 75, 74

[56] References Cited

U.S. PATENT DOCUMENTS

| | | | |
|---|---|---|---|
| 180,200 | 7/1876 | Chapman | 229/75 |
| 311,946 | 2/1885 | Bishop | 229/75 |
| 403,604 | 5/1889 | Donnell | 229/75 |
| 1,306,378 | 6/1919 | Hogan | 229/74 |
| 1,850,369 | 3/1932 | Andrews | 229/74 |
| 3,237,970 | 3/1966 | Mudd, Jr. | 229/69 |
| 3,330,470 | 7/1967 | Timms | 229/74 |
| 3,525,470 | 8/1970 | Carrigan | 229/68 R |
| 4,323,608 | 4/1982 | Denny et al. | 283/81 X |
| 4,529,229 | 7/1985 | Glibbery | 283/81 |

FOREIGN PATENT DOCUMENTS

| | | | |
|---|---|---|---|
| 45965 | 2/1974 | Australia | 206/610 |
| 141045 | 9/1930 | Switzerland | 206/610 |
| 510989 | 11/1939 | United Kingdom . | |
| 1151006 | 5/1969 | United Kingdom . | |
| 1475304 | 6/1977 | United Kingdom . | |
| 2060558 | 5/1981 | United Kingdom . | |
| 2115744 | 9/1983 | United Kingdom . | |
| 2127378 | 11/1984 | United Kingdom . | |

*Primary Examiner*—Stephen Marcus
*Assistant Examiner*—Bryon Gehman
*Attorney, Agent, or Firm*—Birch, Stewart, Kolasch & Birch

[57] ABSTRACT

A label in the form of an envelope formed from a single folded sheet, the sheet being divided into a row of three rectilinear panels, the middle panel having at one longitudinal edge thereof a lower panel and at the other longitudinal edge thereof an upper panel which is separated from the middle panel by a line of perforations, the envelope being formed by folding the two outer panels of the row and the lower panel over the rear face of the middle panel so that the envelope is closed either by adhering the rear face of the envelope to a surface or by folding the upper panel or a portion thereof over the rear face of the middle panel, whereby the envelope so closed can be opened by tearing along the line of perforations.

7 Claims, 5 Drawing Sheets

LABEL ENVELOPE WITH BACKING SHEET

This application is a continuation of application Ser. No. 703,591, filed on Feb. 20, 1985, now abandoned.

BACKGROUND OF THE INVENTION

The present invention relates to labels in the form of an envelope formed from a single folded sheet and in particular to labels to be adhered to a container and for containing a booklet or sheet of instructions relating to the product in the container.

It is frequently desirable to be able to attach a booklet or a sheet of printed instructions to a product, and, to avoid soiling of the booklet or sheet during handling of the product or to avoid loss of the booklet or sheet during such handling, it is desirable that the booklet or sheet should be enclosed in an envelope and held from falling out. If the means for holding the booklet or sheet can be made such as to require a non-repeatable action to open the envelope and remove the booklet or sheet from the envelope, they will afford an indication of unauthorised tampering.

The present invention provides a label in the form of an envelope formed from a single folded sheet, the sheet being divided into a row of three rectilinear panels, the middle panel having at one longitudinal edge thereof a lower panel and at the other longitudinal edge thereof an upper panel which is separated from the middle panel by a line of perforations, the envelope being formed by folding the two outer panels of the row and the lower panel over the rear face of the middle panel so that the envelope is closed either by adhering the rear face of the envelope to a surface or by folding the upper panel or a portion thereof over the rear face of the middle panel, whereby the envelope so closed can be opened by tearing along the line of perforations.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
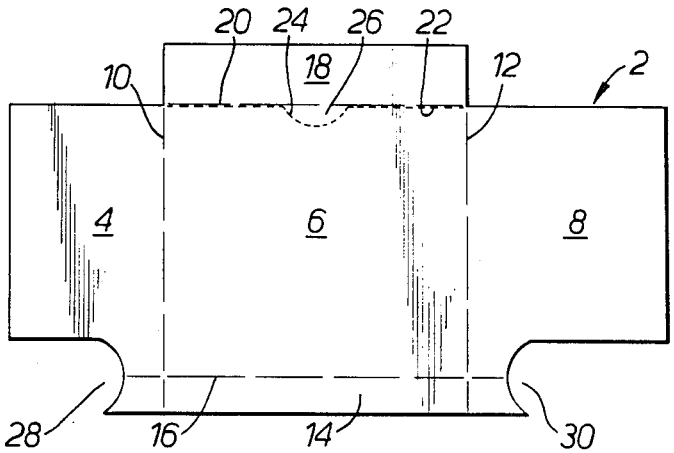
FIG. 1 is a plan view of a sheet to form a label in the form of an envelope in accordance with one embodiment of the present invention.

Referring to FIG. 1, a sheet 2 which may be composed of paper is divided into a row of three rectilinear panels 4, 6, 8. The adjacent pairs of panels 4 and 6 and 6 and 8 are divided by respective transverse fold lines 10 and 12. The central panel 6 is bounded on one edge thereof by a lower panel 14, panels 6 and 14 being divided by a horizontal fold line 16, and on the other edge thereof by an upper panel 18, panels 6 and 18 being divided by a further horizontal fold line 20. The fold lines 10, 12, 16, 20 need not necessarily exist on the sheet 2 prior to the folding of the sheet 2 to form the envelope. Preferably, the width of the central panel 6 is approximately twice that of each outer panel 4, 8. Also, outer panel 8 is wider than outer panel 4 so that when outer panel 8 is folded over outer panel 4, a flap portion 21 (see FIG. 3) of outer panel 8 extends over outer panel 4 and this can readily be adhered to the rear of outer panel 4. A further horizontal line consists of a line of perforations 22 and is either substantially coincident with or parallel and adjacent to the horizontal fold 20.

Figure 2:
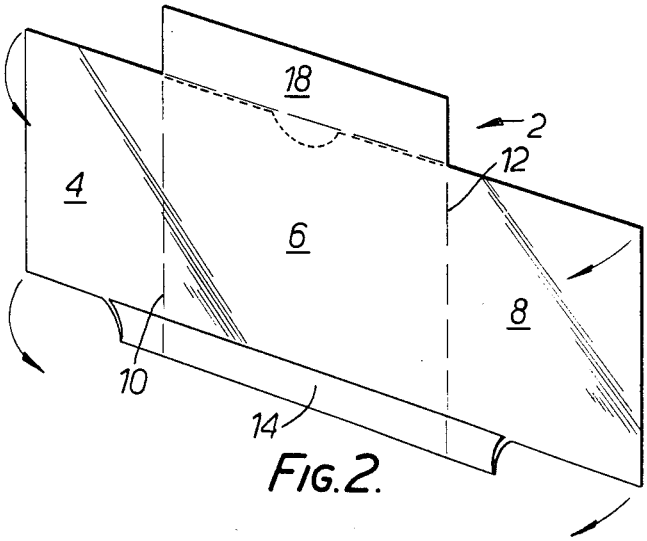
FIG. 2 is a perspective view showing the first folding operation completed and the commencement of the second folding operation on the sheet of FIG. 1.
Figure 3:
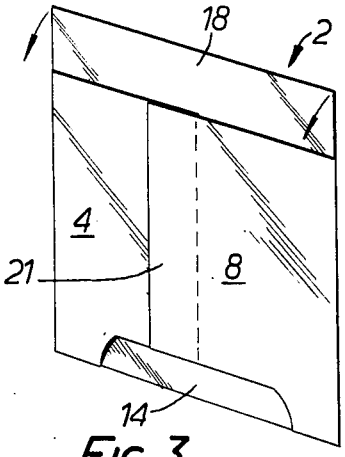
FIG. 3 is a perspective view showing the second folding operation completed and the commencement of the third folding operation on the sheet of FIG. 1.
Figure 4:
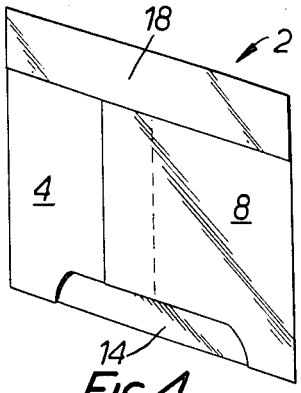
FIG. 4 shows the third folding operation completed and is a perspective rear view of the completed folded envelope formed from the sheet of FIG. 1.
Figure 5:
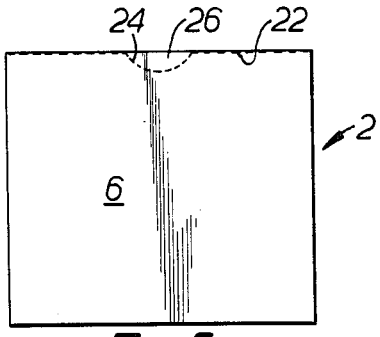
FIG. 5 is a plan view of the front of the envelope of FIG. 4.

The folding steps carried out to form the envelope are shown in FIGS. 2 and 3, the completed envelope being shown in FIGS. 4 and 5. To form the envelope, lower panel 14 is folded along fold line 16 so as partially to cover the rear of central panel 6. Outer panels 4 and 8 are then folded over panel 6 in turn along their respective fold lines 10 and 12 and then upper panel 18 is folded along fold line 20. If desired, the inner surface of panel 18 can be adhered to the upper outer surfaces of panels 4 and 8 so that the envelope is sealed when panel 18 is folded.

The line of perforations 22 is disposed at or very close to a front edge of the completed envelope. Preferably the line of perforations 22 is not straight but includes a downwardly curved portion 24 which is preferably a line being cut through the sheet material which defines a tab 26. The tab 26 can readily be pulled in order to initiate tearing of the line of perforations 22 thereby to open the envelope.

The sheet 2 is dimensioned so that when folded, the rear face of the envelope includes a surface portion of each of the panels 4, 8, 14, 18 other than the central panel 6. Such an arrangement is desirable so that when the rear of the envelope is adhered to a support web (not shown), each of the panels 4, 8, 14, 18 can be individually adhered to the support web so as to provide adequate and secure sealing of the envelope. To this end, the lower edge of each of the two outer panels 4, 8 has a respective cut-away portion 28, 30 so that when the two outer panels are folded over the folded lower panel 14, the lower panel 14 is not completely covered by the two outer panels 4, 8. The cut-away portions 28, 30 are dimensioned so that when the envelope is folded, the free horizontal edge of lower panel 14 is covered along its length by panels 4 and 8 so that the envelope can be adequately sealed. In a preferred arrangement, a number of the envelopes can be adhered in succession on a reel of release backing material. The envelopes can be adhered either directly to the release backing material or to a self-adhesive support web which is adhered itself to the release backing material via the self-adhesive surface.

It will be apparent that the sequence of folding and the dimensions of the panels can be varied in a number of ways while still producing an envelope having a front face provided with a line of perforations and a rear face comprising a number of panels which are adhered together or can be adhered toether by means of a support web.

Figure 6:
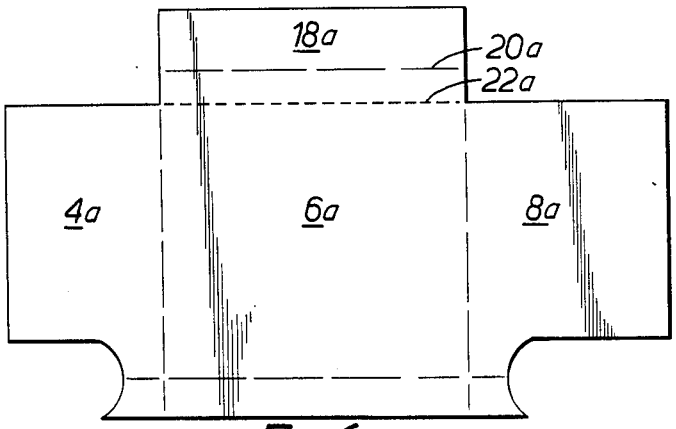
FIG. 6 is a plan view of a sheet to form an envelope in accordance with a second embodiment of the invention.
Figure 7:
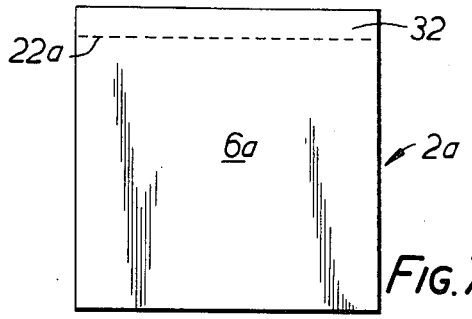
FIG. 7 is a plan view of the front of the envelope formed by folding the sheet of FIG. 6.

An alternative embodiment of the invention is shown in FIGS. 6 and 7 which correspond generally to FIGS. 1 and 5 respectively. The embodiment of FIGS. 6 and 7 differs from that of FIGS. 1 to 5 in that the central panel 6*a* is extended upwardly and the line of perforations 22*a* is located parallel to and spaced from the fold line 20*a* between upper panel 18*a* and central panel 6*a*. The distance between the line of perforations 22*a* and fold line 20*a* is, for example, 20 mm. This results in the front face, (which includes the central panel 6 of the folded envelope), having a line of perforations 22*a* across its width and spaced from the upper edge of the front face. The upper portion 32 of the envelope above the line of perforations 2*a* can readily be torn off along the line of perforations 22*a* thereby to open the envelope. The line of perforations 22*a* is shown in FIGS. 6 and 7 as being in a straight line. However, the line of perforations may alternatively include a curved portion which is cut through the sheet material and defines a tab, in a manner similar to that shown in the embodiment of FIGS. 1 to 5.

The preferred use of the folded envelope is for it to be adhered by its rear face to a container, such as a box, packet, bottle or tin. Prior to folding the envelope, a booklet, sheet of instructions or any other article can be placed over the rear face of panel 6 and then enclosed within the folded envelope.

Figure 8:
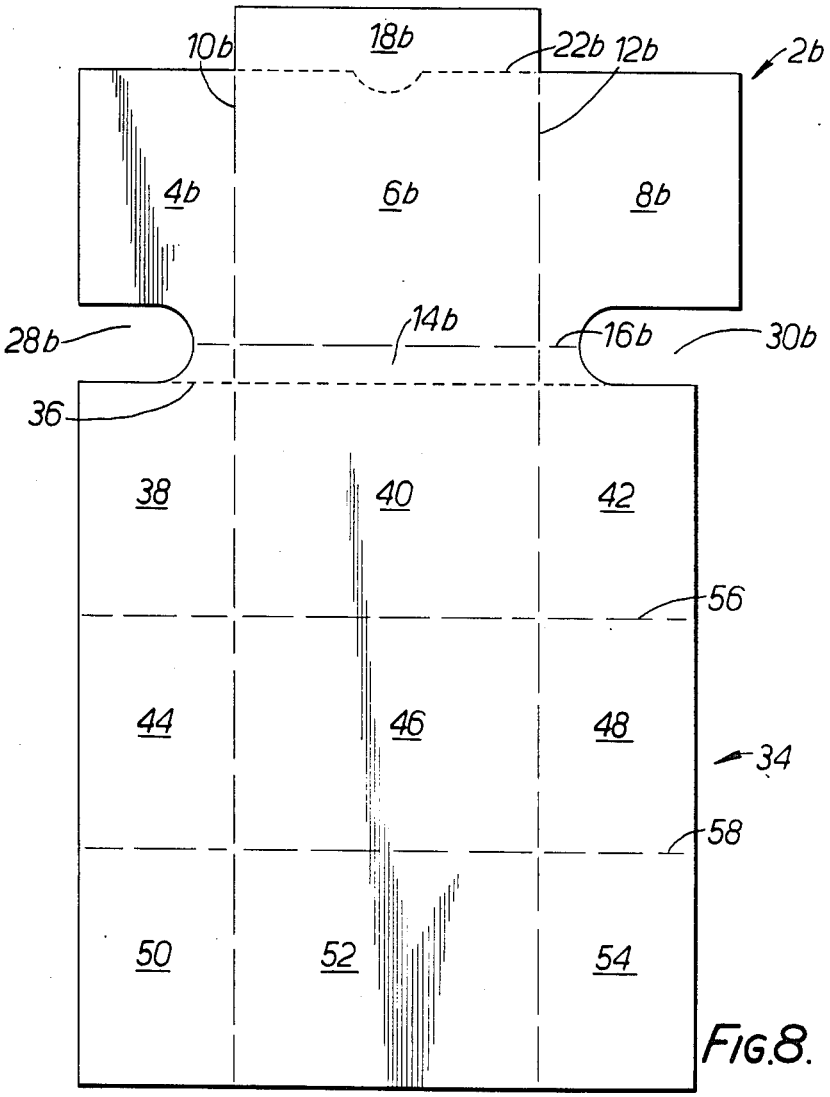
FIG. 8 is a plan view of a combined sheet and envelope in accordance with a third embodiment of the invention.

Referring to FIG. 8 there is shown a combined sheet and envelope in accordance with a further embodiment of the present invention. The combined sheet and envelope is a modification of the sheet and envelope disclosed in my British patent specification No. 2115744. The single folded sheet 2*b* includes a sheet portion 34 which is attached to the lower panel 14 by a second line of perforations 36. The sheet portion 34 may be of any desired size or shape, provided that it can be folded up and then folded, together with lower panel 14*b*, along fold line 16*b* so that it lies over the row of panels 4*b*, 6*b*, 8*d* of the envelope. The envelope can then be folded up as aforesaid with the sheet portion 34 being enclosed in the folded envelope. On opening the envelope by tearing along the first-mentioned line of perforations 22*b*, the sheet portion 34 can be removed from the open envelope and detached thereform by tearing along the second line of perforations 36. The preferred form of sheet portion 34 shown in FIG. 8 consists of three horizontal rows of three rectilinear panels each. The first row of panels 38, 40, 42 is adjacent the second line of perforations 36, with the panels 38, 40, 42 being divided transversely by extensions of the vertical fold lines 10*b*, 12*b* which transversely divide the row of panels 4*b*, 6*b*, 8*d* in the envelope. The outer panels 38, 42 each have a width equal to the width of the outer panel 4*b* in the envelope. The height of the panels 38, 40, 42 is the same and the sum of that height and the height of the lower panel 14*b* is substantially the same as that of the central panel 6*b* of the envelope. The second and third row of panels 44, 46, 48 and 50, 52, 54 have the same shape and dimensions as the first row of panels 28, 40, 42. The second row is below the first row and is divided therefrom by a fold line 56, with the panels 44, 46, 48 being divided by extensions of vertical fold lines 10*b*, 12*b* similarly. The third row is below the second row and is divided therefrom by a fold line 58, with the panels 50, 52, 54 also being divided by extensions of vertical fold lines 10*b*, 12*b*.

To fold up the sheet portion 34, the third row 50, 52, 54 is folded over the second row 44, 46, 48 along fold line 58 and then the second and third rows are then folded over the first row 38, 40, 42 along fold line 56. The three folded rows and lower panel 14 are then folded over the row of three panels, 4*b*, 6*b*, 8*b* of the envelope. The envelope is then folded up as described The provision of the cut-away portions 28*b*, 30*b* ensures that in use the lower panel 14*b* is adhered directly either to a backing sheet (not shown) or to a container. When the sheet portion 34 is pulled out of the folded envelope, lower panel 14 remains firmly adhered as aforesaid and the sheet portion 34 and the envelope are cleanly separated along the second line of perforations 36. If the lower panel 14*b* were not so secured, on pulling the sheet portion 34, the lower panel 14*b* would tend to be pulled into the envelope, thereby causing crumpling or even tearing of the sheet material of the envelope and rendering it difficult to re-insert the sheet portion 34 into the envelope subsequently.

Figure 9:
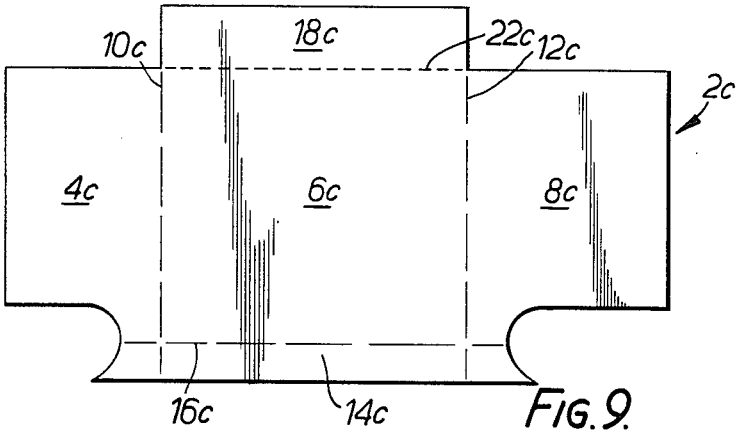
FIG. 9 is a plan view of a sheet to form a label in the form of an envelope in accordance with a fourth embodiment of the invention.
Figure 10:
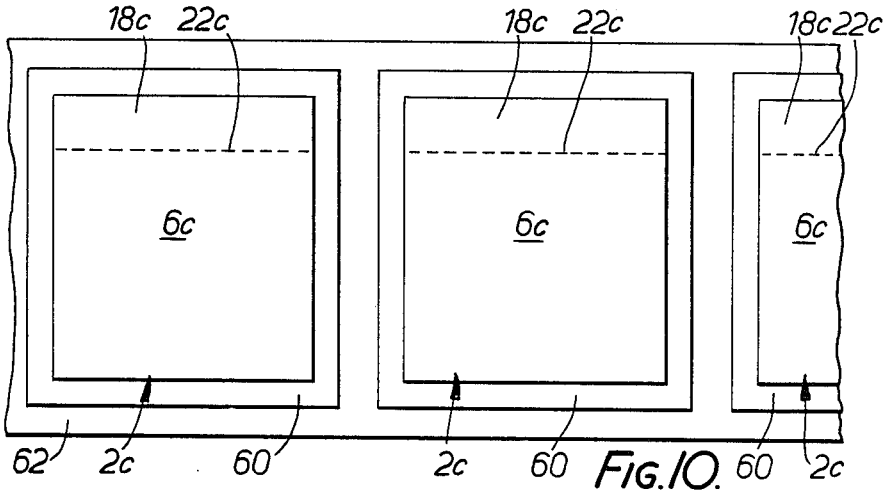
FIG. 10 is a plan view of a number of envelopes formed from the sheet of FIG. 9 when mounted on a self-adhesive support web and carried on a length of a release backing material.

Referring to FIGS. 9 and 10 there is shown a further embodiment of the present invention. The sheet 2*c* is similar to that of FIG. 1 except that the upper panel 18*c* is not folded over the central panel 6*c*. A straight line of perforations 22*c* is provided between the upper panel 18*c* and the central panel 6*c*. To form the envelope, the outer panels 4*c*, 8*c* and the lower panel 14*c* are each folded along their respective fold lines 10*c*, 12*c*, 16*c* over central panel 6*c*. The rear face of the folded sheet 2*c* consists of the rear surface of upper panel 18*c* and a portion of each of the folded panels 4*c*, 8*c*, 14*c*.

The rear face of the folded sheet (i.e. envelope) can be adhered directly to a container. Since the rear surface of upper panel 18*c* and the rearwardly facing surfaces of the three folded panels are adhered to the container, the envelope is maintained in a closed configuration and the contents of the envelope cannot fall out. To open the envelope, the line of perforations 22*c* can be torn thereby to separate the adhered upper panel 18*c* from the remainder of the adhered envelope. The contents can then be removed and, if desired, subsequently replaced into the pocket formed by the remainder of the envelope.

Preferably, as is shown in FIG. 10, the envelopes can each be mounted on a respective support layer 60. The support layer 60 is coated on its rear face with a pressure-sensitive adhesive so that it is self-adhesive and is adhered via the self-adhesive surface to a release backing material web 62. Preferably, a number of the envelope/support web combinations are carried in succession on a length of release backing material web 62. The support layer 60 may be composed of paper.

An advantage of the embodiments of FIGS. 9 and 10 is that the line of perforations can readily be torn manually in order to open the envelope. In addition, manufacture is facilitated since there is no need to fold the upper panel 18*c* over the central panel 6*c*.

Figure 11:
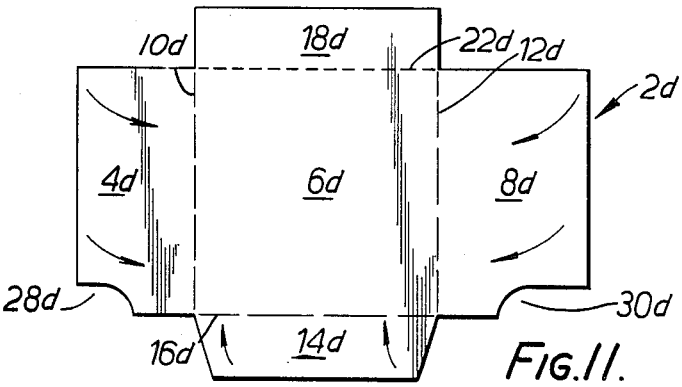
FIG. 11 is a plan view of a sheet to form an envelope in accordance with a fifth embodiment of the invention.
Figure 12:
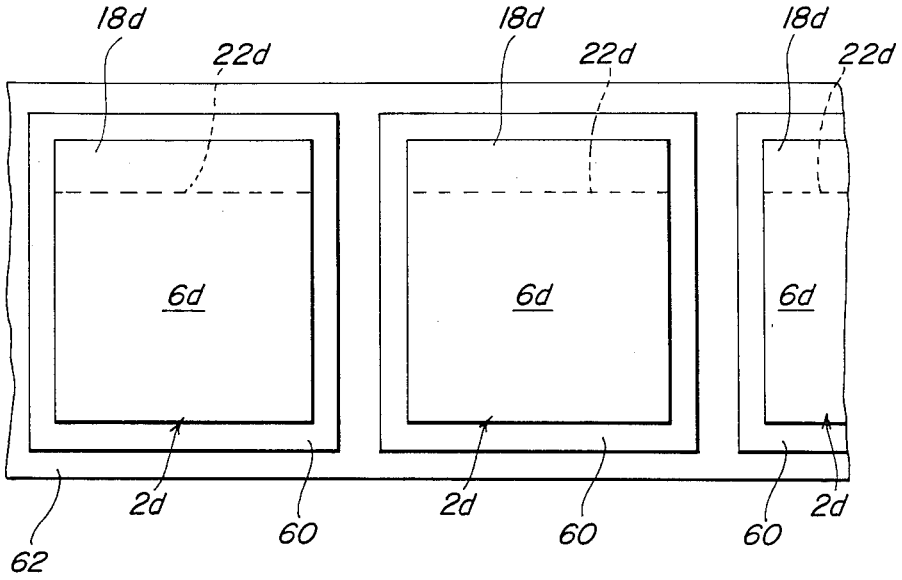
FIG. 12 is a plan view of a number of envelopes formed from the sheet of FIG. 11 when mounted on a self-adhesive support web and carried on a length of a release backing material.

A further preferred embodiment of the invention is shown in FIGS. 11 and 12. The sheet 2*d* comprises the row of three rectilinear panels 4*d*, 6*d*, 8*d* which are divided by transverse fold lines 10*d*, 12*d*. The lower panel 14*d* is separated from the central panel 6*d* by a fold line 16*d* and the upper panel 18*d* is separated from the central panel 6*d* by a line of perforations 22*d*. To form the envelope, panel 4*d* is folded about fold line 10*d* over central panel 6*d* as shown and then panel 8*d* is folded about fold line 12*d* over central panel 6*d*, panel 4*d* is substantially half the length of the central panel 6*d* and panel 8*d* is made longer than panel 4*d* so that panel 8*d* covers the edge of panel 4*d*. Panel 14*d* is then folded about fold line 16*d* over the folded panels 4*d* and 6*d* so that a pocket or pouch is formed between panel 6*d* on one side and panels 4*d*, 8*d* and 14*d* on the other side.

An article such as a booklet may be inserted into the pocket or pouch and then the rear face of the folded envelope, the rear face comprising the uncovered parts of panels 4*d* and 8*d*, panel 14*d* and panel 18*d*, is then adhered either directly to a container or to a support layer which may then itself be adhered to a container. As shown in FIG. 12, a number of the envelope/support web combinations may be carried in succession on a length of release backing material 62. In this way the the booklet is retained safely within the pocket or pouch due to the adhesion of upper panel 18*d* to the container or support web which closes off the top of the pocket or pouch. The booklet and the front face of central panel 6*d* are printed with information relating to the product in the container. To open the envelope and remove the booklet therefrom when the envelope is attached to the container, the upper panel 18*d* and the central panel 6*d* are separated by tearing along the line of perforations 22*d*. The pocket or pouch is thereby accessible and the booklet may be removed. When a user has finished with the booklet, he can re-insert it into the pocket or pouch for future use.

An advantage of the embodiment of FIG. 11 is that since panel 14*d* is folded over panels 4*d* and 8*d* and is the last folding step, the inside of the pocket or pouch does not include an upwardly directed edge of panel 14*d* which would tend to be caught by the bottom edge of the booklet as it is inserted into the pocket or pouch. Thus the booklet can readily be pushed right to the bottom of the pocket or pouch.

Preferably, the two panels 4*d*, 8*d* each have at the respective free bottom corner thereof a respective cut-away portion 28*d*, 30*d*. The cut-away portions 28*d*, 30*d* help to ensure that when the envelope is folded as aforesaid, there is no overlapping of the these panels 4*d*, 8*d*, 14*d* at the bottom edge of the envelope which would tend to cause crumpling of the edges of the panels 4*d* and 8*d* in the region of fold line 16*d*.

My co-pending British patent application No. 8226252 (published as British patent specification No. 2127378) describes and claims a method of producing a succession of self-adhesive labels carried on a backing of release material. That method can be used to produce a web of release backing material carrying thereon a succession of the labels of the present invention.

The invention being thus described, it will be obvious that the same may be varies in many ways. Such variations are not to be regarded as a departure from the spirit and scope of the invention, and all such modifications as would be obvious to one skilled in the art are intended to be included within the scope of the following claims.

I claim:

1. A self-adhesive label which is carried on a backing of release material, the label comprising:

an envelope formed from a single folded sheet, the sheet being divided into a row of three rectilinear panels including a middle and two outer panels, said middle panel having at one longitudinal edge thereof a lower panel and at the other longitudinal edge thereof an upper panel which is separated from said middle panel by a line of perforations, the envelope being formed by folding said two outer panels of said row and said lower panel over the rear face of said middle panel, a front face of the envelope comprising said middle panel and said upper panel and a rear face of the envelope comprising the rearwardly exposed surface portions of the folded over outer panels and lower panel and the rearwardly facing surface of the upper panel;

a paper article which is contained within the folded envelope; and a self-adhesive support layer which is carried on the backing of release material, the support layer having a self-adhesive rear face which is adhered to the backing of release material and having a front face, said rear face of the envelope being adhered to the front face of said support layer thereby to close the envelope, whereby the envelope so closed can be opened by tearing along the line of perforations.

2. A self-adhesive label according to claim 1, wherein said paper article is a booklet.

3. A self-adhesive label according to claim 1, wherein said paper article is a sheet of printed instructions.

4. A self-adhesive label according to claim 1, wherein said paper article comprises a sheet portion which is attached to said lower panel of the single folded sheet by a second line of perforations and prior to folding said two outer panels said sheet portion and said lower panel are folded over said row of three rectilinear panels whereby said sheet portion is enclosed in the envelope but can be removed from the open envelope and detached therefrom by tearing along said second line of perforations.

5. A succession of self-adhesive labels carried on a release backing material web, each label comprising:

an envelope formed from a single folded sheet, the sheet being divided into a row of three rectilinear panels including a middle and two outer panels, said middle panel having at one longitudinal edge thereof a lower panel and at the other longitudinal edge thereof an upper panel which is separated from said middle panel by a line of perforations, the envelope being formed by folding said two outer panels of said row and said lower panel over the rear face of said middle panel, a front face of the envelope comprising said middle panel and said upper panel and a rear face of the envelope comprising the rearwardly exposed surface portions of the folded over outer panels and lower panel and the rearwardly facing surface of the upper panel;

a paper article which is contained within the folded envelope; and a self-adhesive support layer which is carried on the release backing material web, the support layer having a self-adhesive rear face which is adhered to the release backing material web, said rear face of the envelope being adhered to the front face of said support layer thereby to close the envelope, whereby the envelope so closed can be opened by tearing along the line of perforations.

6. A self-adhesive label according to claim 5, wherein said paper article is a booklet.

7. A self-adhesive label according to claim 5, wherein said paper article is a sheet of printed instructions.

* * * * *